United States Patent [19]

Kennedy et al.

[11] 4,418,495

[45] Dec. 6, 1983

[54] MINIATURE RACING VEHICLE AND WRIST-BORNE LAUNCHING PLATFORM ASSEMBLY

[75] Inventors: Melvin R. Kennedy, Hampton Bays, N.Y.; Dietmar Nagel, Chester, N.J.

[73] Assignee: Buddy L Corporation, New York, NY

[21] Appl. No.: 345,475

[22] Filed: Feb. 3, 1982

[51] Int. Cl.[3] ..... A63H 11/10

[52] U.S. Cl. ..... 46/206; 46/202

[58] Field of Search ..... 46/206, 202, 208, 209, 46/201

[56] References Cited

U.S. PATENT DOCUMENTS

| | | | |
|---|---|---|---|
| 3,789,540 | 2/1974 | Convertine et al. | 46/206 X |
| 4,016,674 | 4/1977 | Resnick et al. | 46/206 X |
| 4,267,661 | 5/1981 | Hanson | 46/1 K |
| 4,363,186 | 12/1982 | Goldfarb et al. | 46/202 X |

*Primary Examiner*—Mickey Yu

*Attorney, Agent, or Firm*—Michael Ebert

[57] ABSTRACT

A miniature racing vehicle and wrist-borne launching platform assembly in which the platform includes a retractable ramp extending from the front end thereof. Affixed to the platform is an open-fronted transparent cover to define a hangar for the spring-powered vehicle, the hangar having a side slot to admit the stem of a wind-up knob projecting laterally from the vehicle whereby the knob is outside of the hangar and accessible to the player. The sides of the vehicle are frictionally engaged by holding elements on the corresponding sides of the hangar. A push-button actuator mounted on the rear of the hangar has a pusher which abuts the rear of the vehicle, whereby when the button is pressed, it acts to advance and free the wound-up vehicle from the holding elements to cause the charged vehicle to take off.

10 Claims, 9 Drawing Figures

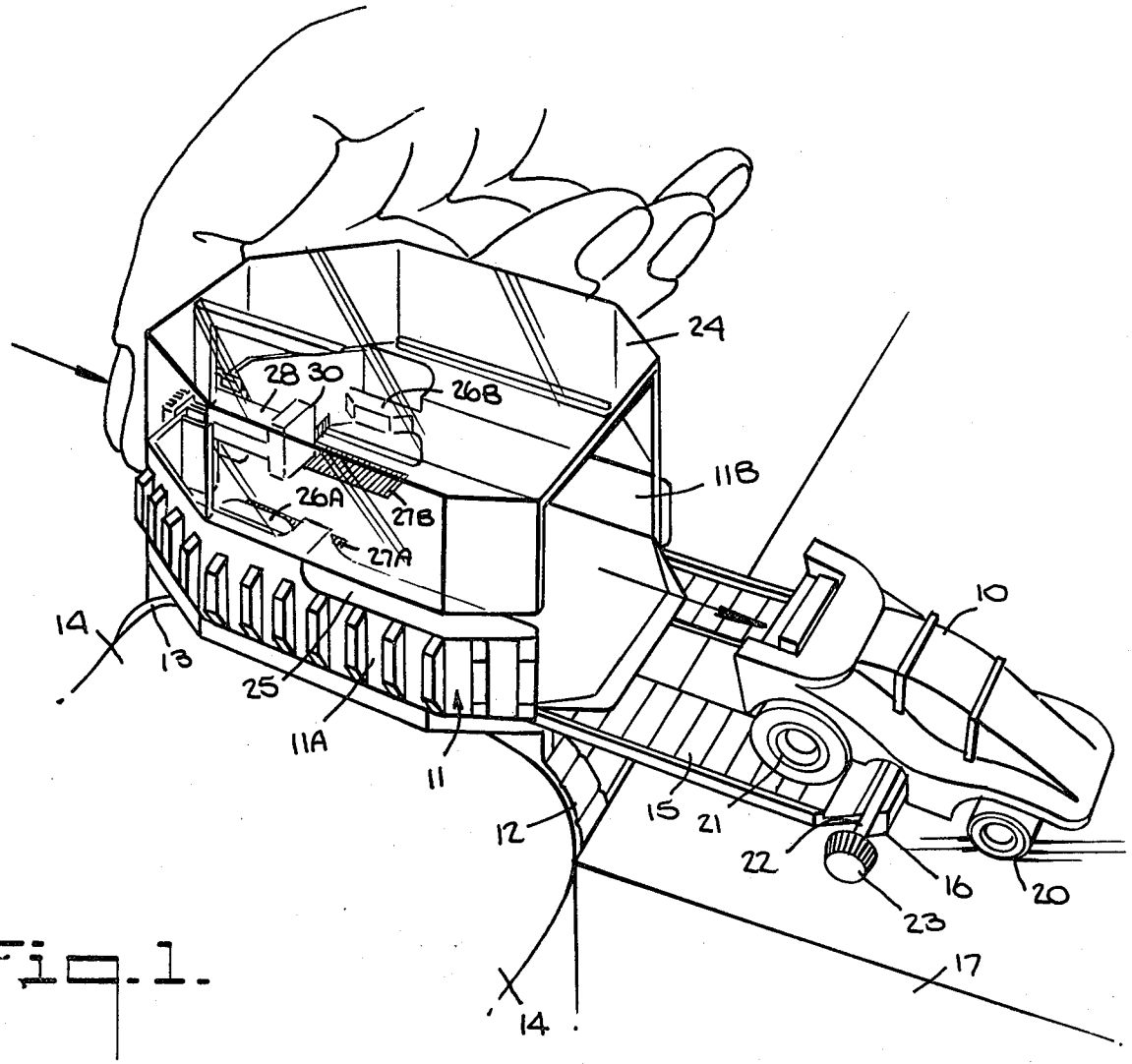
Fig. 1.
Fig. 2.
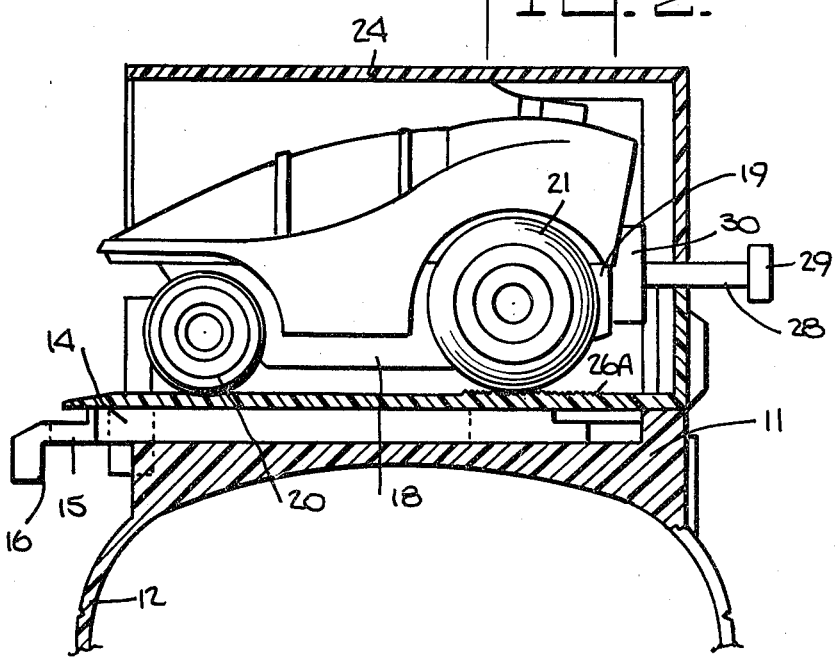

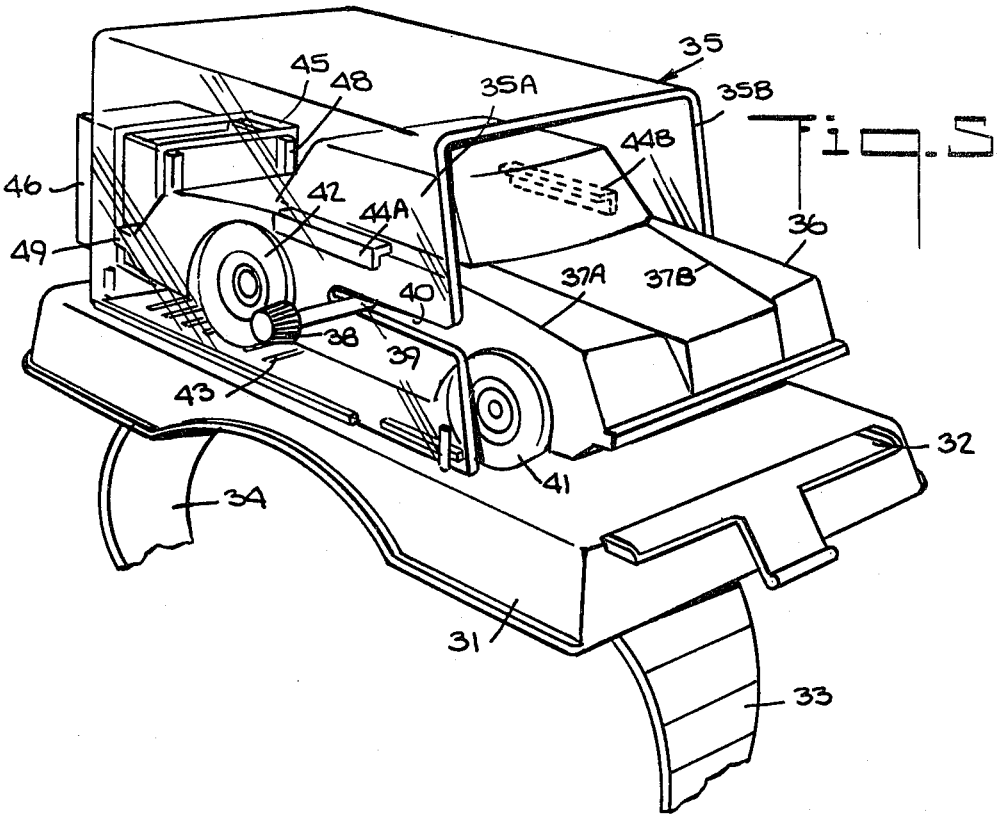
Fig. 5.
Fig. 6.
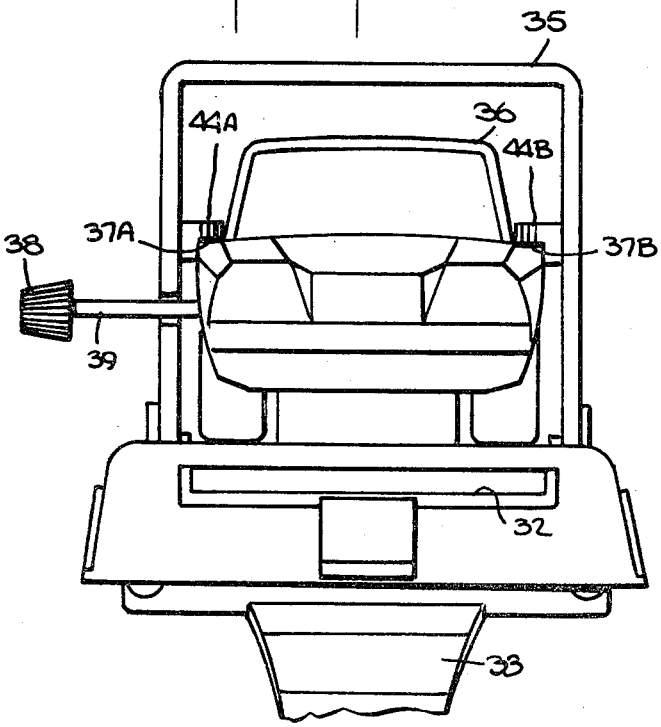
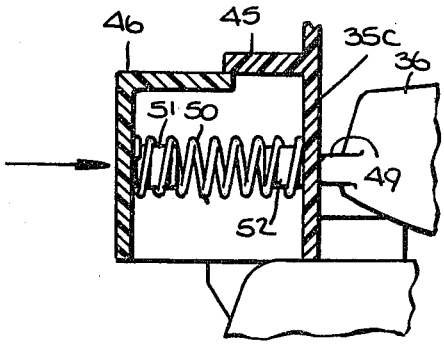
Fig. 7.

MINIATURE RACING VEHICLE AND WRIST-BORNE LAUNCHING PLATFORM ASSEMBLY

BACKGROUND OF INVENTION

This invention relates generally to toy racing vehicles, and in particular to a wrist-borne launcher for miniature vehicles of this type.

Miniature racing cars are known which make use of a spring-powered wind-up motor, the car being housed within a transparent cover hinged to a launching platform that straps onto the wrist of the player. The cover, which is spring-biased, is held down by a front latch. In order to launch the car after it is wound up, one must first extend a retractable ramp from the front end of the platform and then push a rear button which acts to release the latch, permitting the cover to swing up to expose the car.

But this push-button action does not release the car, for it is retained on the platform by means of a lug which engages a stop on the car undercarriage. To effect release, the button must again be depressed, this action serving to laterally displace the lug to release the vehicle which then runs down the ramp onto a table or other playing surface.

This prior arrangement is relatively complex, for it requires a special mechanism to coordinate the action of the push-button with both the operation of the cover latch and the car-holding lug. Also, when a child wishes to return the vehicle to the platform for replay, he must be careful to properly place the vehicle so that it is engaged by the retaining lug, and then close the raised cover so that it is latched.

Another drawback of this prior arrangement is that the push-button functions only to release the car and makes no contribution to the speed of car movement so that the player has no control over car speed other than by the extent he winds up the spring motor.

Since the above-described toy is intended mostly for pre-school children, it has obvious practical disadvantages, for children in this age group are notoriously hard on toys; and with a hinged cover and a somewhat tricky push-button mechanism, the toy is not likely to survive rough handling.

SUMMARY OF INVENTION

In view of the foregoing, the main object of this invention is to provide a miniature toy racing vehicle and wrist-borne launching platform assembly of improved and simplified construction which is easy to operate and has a long and effective working life.

More particularly, an object of the invention is to provide an assembly of the above type in which the vehicle is housed within a transparent cover which is fixedly secured to the platform to define a hanger which has an open end to permit ejection of the vehicle therefrom when the vehicle is pushed by a rear push-button.

A significant feature of the invention is that the push-button is disassociated from any latching or other control mechanism, for the spring-powered vehicle is frictionally held in place; and when the button is pushed, the charged-up vehicle is advanced and freed, the pushed vehicle then proceeding down the ramp extending from the platform.

Also an object of the invention is to provide a trouble-free, uncomplicated and sturdy assembly of the above type which may be mass-produced at low cost.

Briefly stated, these objects are attained in a miniature racing vehicle and wrist-borne launching platform assembly in which the platform is provided with a retractable ramp extending from the front end thereof, the platform having a transparent cover affixed thereto to define a hanger for the vehicle having an open front end. The hangar has a side slot therein to admit the stem of a wind-up knob projecting laterally from the vehicle, the knob being outside the hanger and therefore accessible to the player.

The sides of the vehicle are frictionally engaged by holding elements on the corresponding sides of the hangar. A push-button mounted on the rear of the hangar has a pusher which abuts the rear of the vehicle. When the push-button is pressed, it frees the wound-up vehicle from the holding elements to cause the charged vehicle to take off.

OUTLINE OF DRAWINGS

For a better understanding of the invention as well as other objects and further features thereof, reference is made to the following detailed description to be read in conjuction with the accompanying drawings, wherein:

FIG. 1 is a perspective view of a first preferred embodiment of an assembly in accordance with the invention, the vehicle being shown running down the ramp;

FIG. 2 is a longitudinal section taken through the assembly in the vertical plane, with the vehicle released from the hangar;

FIG. 5 is a perspective view of a second embodiment of an assembly having a spring-biased push-button actuator;

FIG. 6 is a front view of the second embodiment;

FIG. 7 shows, in section, the spring-biased push-button;

DESCRIPTION OF INVENTION

First Embodiment

Figure 3:
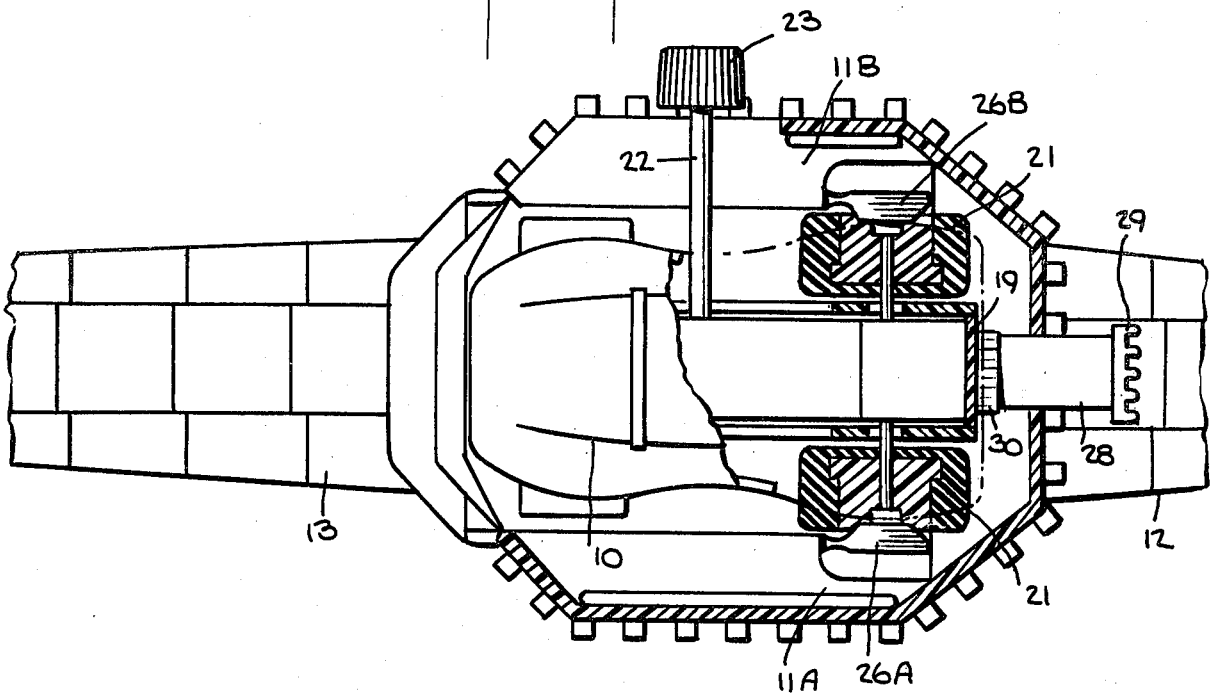
FIG. 3 is a longitudinal section taken through the assembly in the horizontal plane, with the vehicle in place in the hangar.
Figure 4:
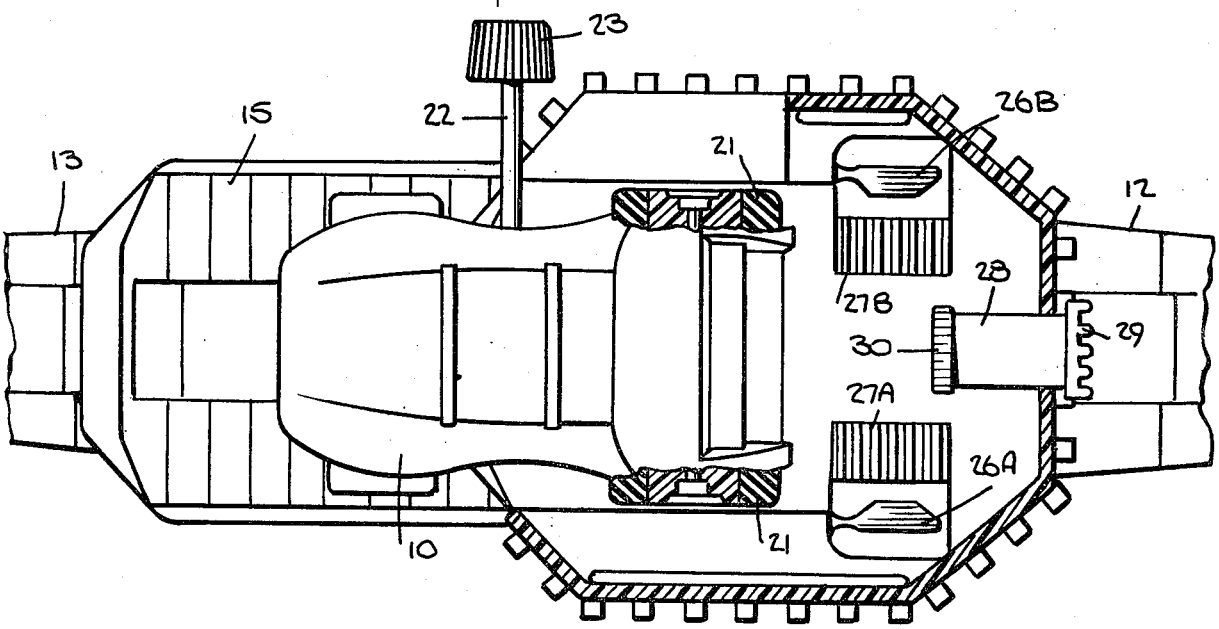
FIG. 4 is the same as FIG. 3, except that the pushbutton has been actuated to free the vehicle.

Referring now to FIGS. 1 to 4, there is shown an assembly in accordance with the invention including a miniature racing car 10 and a wrist-borne platform 11 therefor. The platform is provided at opposing ends with flexible straps 12 and 13, making it possible to loop the assembly onto the wrist 14 of the player. In practice, one of the straps may be provided with a series of holes and the other with a buckle (not shown) adapted to receive the tail of the first strap and having a pair of pegs which go into a selected pair of the holes to retain the straps onto the wrist. Any existing form of fastener may be used for the straps, such as "Velcro" fasteners or conventional buckles.

Received within platform 11 is a retractable ramp 15 whose front end is provided with a downwardly depending flange 16 functioning as a handle to facilitate withdrawal of the ramp from the platform so that it may form a bridge onto a playing surface 17, as shown in FIG. 1.

Vehicle 10 is in a racing car format and includes a chassis 18 having a flat vertical rear bolster 19, the chassis supporting tired front wheels 20 and tired rear wheels 21 of larger diameter. Installed within the car is a standard spring-powered clockworks motor (not shown) whose spring is coupled by transmission gears to rear wheels 21. The inner end of the spiral spring is operatively linked to the stem 22 of a wind-up knob 23, the stem projecting laterally from the vehicle. A suitable wind-up motor for this purpose is disclosed in U.S. Pat. No. 2,057,557.

Affixed to platform 11 is a transparent cover 24 to define a hangar for vehicle 10, the cover having an open front end to permit the vehicle to exit from the hangar. The hangar is provided on one side with a slot 25 which extends toward the front to admit the stem 22 of the wind-up knob 23, whereby when the vehicle is placed within the hangar, the knob is on the outside thereof and is accessible to the player.

The long sides of platform 11 are provided with parallel guide walls 11A and 11B having rear recesses within which are accommodated a pair of deflectable fingers 26A and 26B acting as holding elements. Formed on the floor of platform 11 adjacent these fingers are a pair of parallel non-slip treads 27A and 27B on which rest the tires of rear wheels 21 when the vehicle is placed within the hangar, as shown in FIG. 2.

As best seen in FIG. 3, fingers 26A and 26B, when the vehicle is within the hangar, engage the hollow axle hubs of rear wheels 21, thereby resisting the displacement of the vehicle from the hangar. And because the tires of the rear wheels are on treads 27A and 27B, rotation of these wheels is arrested, as is necessary when winding up the spring motor to prevent concurrent unwinding of the spring. The entire assembly, save for the motor, may be fabricated of synthetic plastic material.

As best seen in FIG. 2, mounted at the rear of the hangar in an opening in the rear wall of cover 24 is a push-button actuator constituted by an axially-movable piston 28 to whose outer extremity is attached a button 29. The inner end of piston 28 terminates in a pusher 30, which, when the vehicle is in place in the hangar, abuts the rear bolster 19 of the chassis.

Operation

The operating procedure is as follows: Assuming that the vehicle is in place in the hangar and occupies the position shown in FIG. 2 with the rear bolster 19 of the chassis abutting pusher 30 of the actuator, button 29 then occupies its fully "out" position, and the rear wheels 21 lie on treads 26A and 26B to prevent rotation thereof.

The player who has the assembly strapped to his wrist then winds up the spring motor by turning knob 23 until the motor is fully charged. He then pulls out ramp 15 and places the ramp onto a playing surface 17, as shown in FIG. 1, to create a bridge between platform 11 and this surface. Finally, he presses button 29 in to force the vehicle out of frictional engagement with deflectable fingers 26A and 26B, thereby releasing the vehicle which now takes off down the ramp, the vehicle then running along surface 17 for a distance determined by the motor charge.

Two or more players can therefore competitively race the vehicles. At the completion of the race, each player can then return his vehicle to the hangar simply by pushing it in until the holding fingers again engage the rear wheel hubs, at which point it becomes possible to again recharge the motor for play. The spacing between parallel guide walls 11A and 11B of the platform is slightly greater than the width of the vehicle, so that when the vehicle is inserted into the hangar, it is properly directed toward the rear.

The push-button actuator does more than release the vehicle from the holding fingers; for by the force of the push one can give the vehicle a head start and thereby gain an advantage over a player who operates his push-button with a lesser force.

Second Embodiment

In the arrangement shown in FIGS. 5, 6 and 7, the assembly includes a platform 31 provided with a retractable ramp 32 and straps 33 and 34 to secure the platform to the wrist of the player. Mounted above the platform is a transparent cover 35 having parallel side walls 35A and 35B to define a hangar for a vehicle 36. The vehicle includes side walls having sloped upper edges 37A and 37B. The spring-powered vehicle is provided with a wind-up knob 38 whose stem 39 is received within a slot 40 formed in cover side wall 35A.

The vehicle includes front wheels 41 and rear wheels 42, the rear wheels being arrested by a non-slip tread 43 on the floor of the platform. The vehicle is frictionally held in place by holding elements 44A and 44B which are mounted on cover side walls 35A and 35B, respectively. These elements are in ledge form and are positioned to engage the upper edges 37A and 37B of the vehicle.

Projected from the rear wall 35C of cover 35 is a square socket 45 which receives a square actuator whose button 46 is provided with a pair of side plates 47 and 48 which project forwardly through parallel slots in the rear wall 35C, these plates abutting the rear bumper 49 of the vehicle.

Button 46 is spring-biased by means of a helical spring 50 (see FIG. 7) which is compressed between a peg 51 on the inside of the button and a peg 52 on the rear wall 35C of the cover, so that the button normally occupies its "out" position.

In operation, after the spring motor is wound up and the ramp extended, the vehicle is released by pushing in button 46 to free the vehicle from holding elements 44A and 44B, at which point the vehicle takes off and runs down the ramp onto the playing surface. To return the vehicle to its hangar, it is pushed into engagement with the holding elements. The parallel side walls of the cover, whose spacing is slightly greater than the width of the vehicle, act as guides therefor.

Third Embodiment

Figure 8:
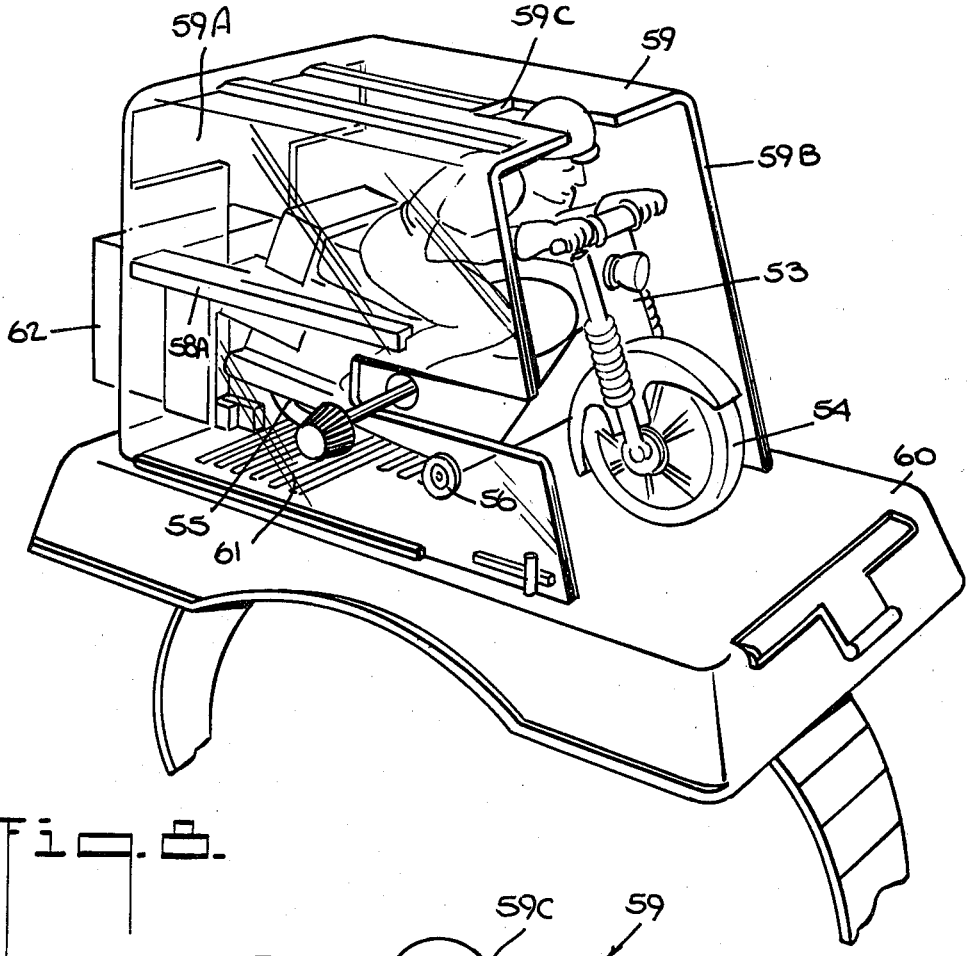
FIG. 8 illustrates, in perspective, a third embodiment of the assembly.
Figure 9:
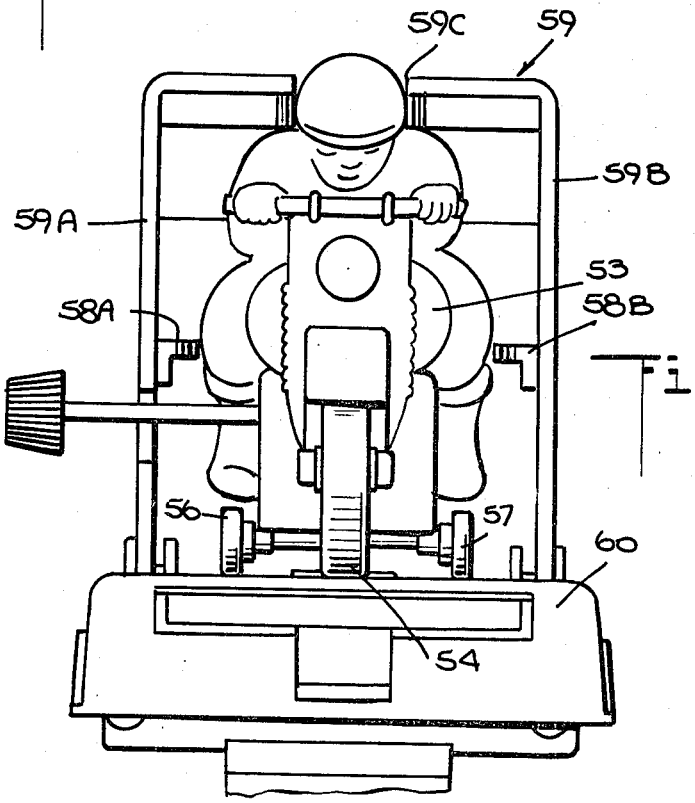
FIG. 9 is a front view of the third embodiment.

In the assembly illustrated in FIGS. 8 and 9, the toy vehicle 53 takes the form of a motorcycle having a driver, the cycle having a single front wheel 54, a single rear wheel 55 and a pair of small stabilizers wheels 56 and 57.

In this instance, the rear structure of the vehicle is engaged by a pair of holding elements 58A and 58B mounted on the parallel side walls 59A and 59B of the transparent cover 59 secured to platform 60. The upper wall of this cover is provided with a notch 59C to accommodate the head of the driver.

The rear wheel 55 of the motor cycle engages a tread 61 on the floor of the platform to arrest this wheel when the motor is being wound. A push-button actuator 62 is provided similar to that in the second embodiment and operating in like fashion to release the motorcycle from the holding elements.

While there have been shown and described preferred embodiments of a miniature racing vehicle with wrist-borne launching platform assembly in accordance with the invention, it will be appreciated that many changes and modifications may be made therein without, however, departing from the essential spirit thereof. Thus the miniature vehicle may take forms other than those illustrated, and may be configured as a helicopter, an airplane or a truck.

I claim:

1. A toy assembly comprising:

A. a spring motor-powered vehicle having a wind-up knob secured to a stem projecting laterally from the vehicle;

B. a platform strappable onto the wrist of a player and including a retractable ramp extending from the front end thereof;

C. a transparent cover affixed to the platform to define a hangar having an open front to accommodate the vehicle with its front end facing the hangar opening, the hangar having a side slot to admit the stem, whereby the wind-up knob is outside the hangar and accessible to the player, said hangar being provided with holding elements which frictionally engage the sides of the vehicle to resist withdrawal thereof; and D. a push-button actuator mounted on the rear of the hangar and having a pusher abutting the rear end of the vehicle whereby when the push-button is pressed in, the pusher advances the vehicle to free it from the holding elements, whereby the vehicle can then run down the extended ramp onto a playing surface.

2. An assembly as set forth in claim 1, wherein said platform is provided at opposite ends with straps which, when joined, loop about the wrist of the wearer.

3. An assembly as set forth in claim 1, wherein said vehicle has a pair of rear wheels which are driven by the motor, and said platform is provided with no-slip treads on which said rear wheels rest when the vehicle is held by the holding elements to prevent rotation of the wheels when the spring motor is being wound.

4. An assembly as set forth in claim 3, wherein said holding elements are constituted by a pair of deflectable fingers which engage the hubs of the rear wheels.

5. An assembly as set forth in claim 4, wherein said deflectable fingers are mounted within rear recesses in a pair of guide walls extending along the sides of the platform.

6. An assembly as set forth in claim 1, wherein said actuator is constituted by a piston which is slidable within an opening in the rear of the hangar, the outer end of the piston having said button secured thereto and the inner end having said pusher secured thereto.

7. An assembly as set forth in claim 6, wherein said vehicle has a chassis with a rear bolster which is engaged by the pusher.

8. An assembly as set forth in claim 1, wherein said vehicle sides have sloped upper edges which are frictionally engaged by ledges mounted on the side walls of the cover functioning as the holding elements.

9. An assembly as set forth in claim 8, wherein said vehicle has a rear bumper and said actuator is a spring-biased push-button having forwardly projecting plates which engage the rear bumper.

10. An assembly as set forth in claim 1, wherein said vehicle is a motorcycle whose rear structure is frictionally engaged by a pair of holding element ledges mounted on the side walls of the cover.

* * * * *